United States Patent [19]

van der Linden

[11] 4,384,433

[45] May 24, 1983

[54] ABRADING DEVICE

[75] Inventor: Jacob A. van der Linden, Kapellen, Belgium

[73] Assignee: Machinefabriek A. van der Linden B.V., Goes, Netherlands

[21] Appl. No.: 306,513

[22] Filed: Sep. 28, 1981

Related U.S. Application Data

[63] Continuation of Ser. No. 91,166, Nov. 5, 1979, abandoned.

[30] Foreign Application Priority Data

Nov. 3, 1978 [NL] Netherlands ..... 7810947

[51] Int. Cl.[3] ..... B24B 21/04

[52] U.S. Cl. ..... 51/138; 51/141; 144/245 A

[58] Field of Search ..... 51/74 R, 110, 135 R, 51/137, 138, 139, 215 R, 215 E; 144/245 A, 249 B

[56] References Cited

U.S. PATENT DOCUMENTS

| | | | |
|---|---|---|---|
| 2,467,978 | 4/1949 | Kerr et al. | 51/137 X |
| 2,649,875 | 8/1953 | Sherman | 144/245 A X |
| 2,674,833 | 4/1954 | Cheverton et al. | 51/137 |
| 2,901,870 | 9/1959 | Zirbel | 51/137 |
| 3,372,516 | 3/1968 | Dickinson et al. | 51/139 X |
| 3,939,611 | 2/1976 | Hesler et al. | 51/139 |

*Primary Examiner*—James G. Smith
*Assistant Examiner*—Roert P. Olszewski
*Attorney, Agent, or Firm*—Diller, Ramik & Wight

[57] ABSTRACT

An abrading device comprising one or more abrasive belt aggregates consisting of an endless abrasive belt passed along guide rollers and a pressing table arranged at a distance above the same in a resilient manner as well as elements for adjusting the distance between the pressing table and the abrasive belt, wherein the pressing table adjustable by setting elements is constantly loaded in a sense away from the abrasive belt by a compensating device neutralizing the weight of the table; owing to the compensating device the pressing table is constantly loaded against gravity so that the amounts of play are eliminated in a direction away from the abrasive belt.

The adjustment of the pressing table can then be performed so that the work piece is machined with an optimum effect.

10 Claims, 1 Drawing Figure

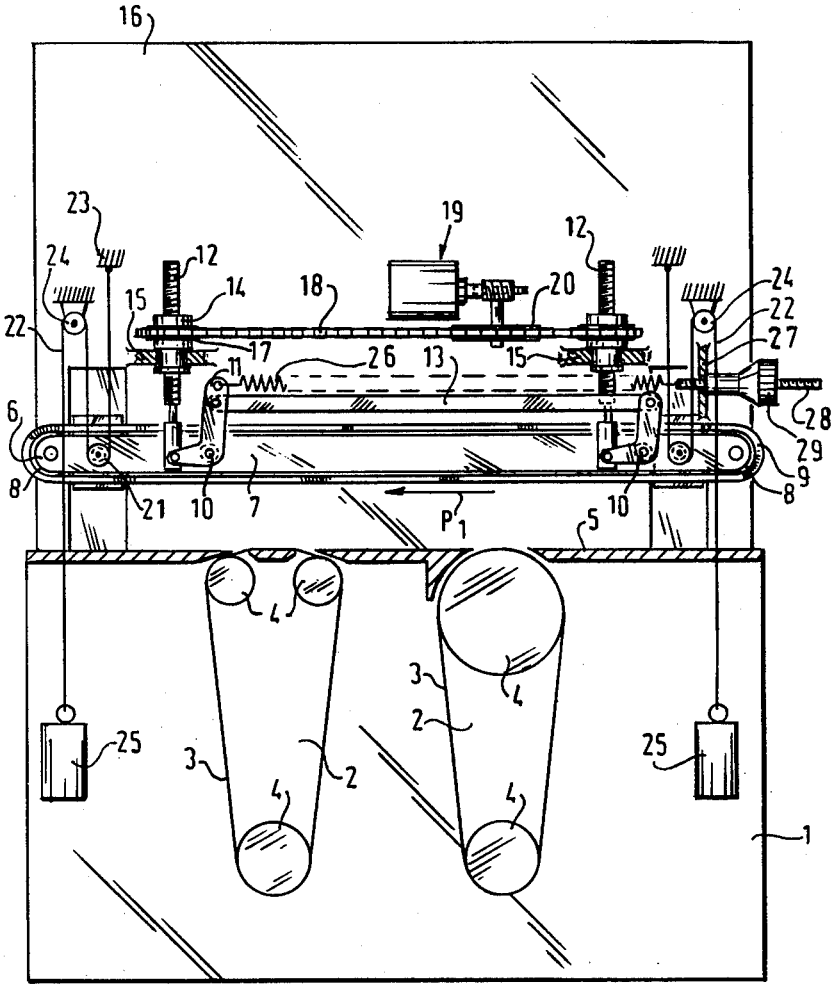
16
23
24
22
6
8
21
10
7
15
12
14
17
11
18
19
20
26
13
15
12
24
22
27
28
29
9
8
10
P'1
5
4
3
2
4
3
2
4
4
25
25
1

ABRADING DEVICE

RELATED U.S. APPLICATION

The application is a continuation of Ser. No. 91,166, filed Nov. 5, 1979 and now abandoned.

BACKGROUND OF THE INVENTION

The invention relates to an abrasing device comprising one or more abrasive belt aggregates consisting of an endless abrasive belt passed along guide rollers and a pressing table arranged at a distance above the same in a resilient manner as well as means for adjusting the distance between the pressing table and the abrasive belt.

With such devices, which are very suitable for use in production lines, it is common practice to dispose the pressing table at such a distance from the abrasive belt that a comparatively slight reduction of the thickness of the product is obtained. The problem involved in these machines is that due to the resilient suspension of the pressing table this table always has a certain amount of play, which the product to be abraded has to overcome first before the pressing table exerts the correct pressure on the work piece, since the work piece has to push the table upwards against the force of gravity in order to obviate the amount of play. This problem becomes even more pronounced when the pressing table can be displayed by the setting means. The setting means as well exhibit the conventional amounts of play, which the work piece to be treated also has to overcome first.

OBJECTS OF THE INVENTION

The invention has for its object to obviate the aforesaid problem by a device in which the pressing table adjustable by setting means is constantly loaded in a sense away from the abrasive belt by compensating means neutralising the weight of the table.

Owing to said compensating means the pressing table is constantly loaded against gravity so that the amounts of play are eliminated in a direction away from the abrasive belt. The adjustment of the pressing table can then be performed so that the work piece is machined with an optimum effect.

SUMMARY OF THE INVENTION

In a preferred embodiment the compensating means are formed by at least one weight, which is connected with the pressing table by way of a flexible element passed around a disc arranged on a frame supporting the abrasive belt. The use of such weights has the advantage that little space is occupied at the pressing table itself, where the setting means are disposed, whilst the weights themselves are arranged in the comparatively large space around the abrasive belt aggregates.

In order to reduce the volume of the weights it is advantageous to establish the connection with the pressing table by means of a second disc fastened to the pressing table so that a twin pulley-block is formed.

A particularly effective embodiment is obtained when the setting means are connected with the pressing table through a pivotal arm, which is loaded by an elastic element supported by the frame to an extent such that the pressing table is moved towards the abrasive belt.

The invention will be described more fully with reference to the following description of the drawing of an embodiment.

BRIEF DESCRIPTION OF THE DRAWING

The drawing shows schematically a vertical section of an abrasing device in accordance with the invention.

DETAILED DESCRIPTION OF THE INVENTION

The device mainly comprises a cabinet-like substructure 1, in which two abrasive belt aggregates 2 are accommodated. The abrasive belt aggregates comprise endless abrasive belts 3, which are passed in known manner around guide and drive rollers 4. The disposition of the abrasive belt aggregates with respect to the cabinet-like substructure 1 is such that on the top side the belts just emerge above the supporting face of the cabinet 1 so that an abrasive surface becomes free.

At a distance above the abrasive belt aggregates is arranged a pressing table 6, which comprises a supporting framework 7 holding rollers 8, about which are passed one or more ropes 9. The rollers 8 are directly driven by a motor (not shown) in the framework 7 so that the ropes on the bottom side are driven in the direction of the arrow P1.

Between the rollers 8, on the top side of the lower run of the ropes 9 there may be mounted a pressing plate or a set of pressing rollers in order to maintain accurate parallelism between the lower runs of the ropes 9 and the surface 5.

The framework 7 is provided on the front and rear sides with two stub shafts 10, around which a bell-crank lever 11 is pivotable. One of the lever 11 is pivoted to the lower end of a screw spindle 12, whereas the other limb of the angle lever crank 11 is connected with the same side of the framework 7 by a coupling rod 13.

The screw spindles 12 co-operate with a nut-like body 14 having an inner thread, which body 14 is rotatably supported in an eyelet 15 of a cabinet-like upper structure 16. The rotatable body 14 is provided with a chain sprocket 17, around which is passed a chain 18, which passes furthermore to the chain sprocket 17 of the second screw spindle 12 provided at a distance in the upper cabinet.

The chain 18 can be reciprocated by a chain drive 19 comprising a motor supported in the upper cabinet 16 and driving a chain sprocket 20 through a bevel pinion transmission.

The framework 7 is provided at both ends with a disc 21 rotatably fastened thereto, a flexible element, for example, a rope or chain 22 being passed around said disc. This flexible element 22 is fastened at one end 23 to the upper frame 16 and passed via a disc 24 also fastened to the upper frame 16 towards a compensating weight 25 below in the lower cabinet 1.

It should finally be noted that the other limb of one of the angle lever cranks 11 is provided with a fastening eyelet holding a draw spring 26, which is supported by a plate 27 connected with the upper cabinet 16. For this purpose a screw spindle 28 is passed through the plate 27 and the draw spring 26 is fastened to said spindle, which is provided with a control-knob 29 screwed onto it and bearing by the left-hand face on the plate 27.

The device operates as follows: via the flexible element 22 the compensating weights 25 will exert an upwardly extending force on the framework 7 and hence on the pressing plate 6. This force is such that all amounts of play in the pivotal joints between the angle lever crank 10 and the framework 7 and the screw spindle 12 respectively as well the play between the screw spindle 12 and the rotatable element 14 are obviated in the upward sense. Moreover, the forces of the compensating weights 25 are sufficient for biassing the spring 26 to the desired extent.

The work piece to be abrased is introduced between the pressing table 6 and the top side 5 of the lower cabinet 1 on the righthand side of the device, the ropes 9 conveying the job in the direction of the arrow P1. The lower side of the work piece will be abraded by the abrasive belt 3, whilst a given pressure resulting from the tension of the spring 26 will be exerted on the work piece.

When the work piece has a different thickness, the chain 18 can be turned by energizing the motor 19, the screw spindles 12 being moved upwards or downwards. The table 6 will move accordingly up- and downwards until the desired distance between the table 6 and the surface 5 or the abrasive belt aggregates 2 respectively is attained.

What is claimed is:

1. An abrading device comprising one or more abrasive belt aggregates consisting of an endless abrasive belt passed along guide rollers and a pressing table arranged at a distance above the same, support means for supporting said pressing table in a resilient manner above said belt and including setting means for adjusting the distance between the pressing table and the abrasive belt, said support means also including compensating means neutralising at least the weight of the pressing table to urge it in a direction away from the abrasive belt, said setting means including a pivotal arm pivoted adjacent one end to said pressing table, and said support means includes a spring connected to said arm adjacent its opposite end which loads the pressing table in the direction of the abrasive belt.

2. An abrading device as claimed in claim 1 characterized in that the compensating means are formed by at least one weight which is connected with the pressing table by way of a flexible element passed around a disc provided on a frame supporting the abrasive belt.

3. A device as claimed in claim 2 characterized in that the connection with the pressing table is established by means of a second disc arranged on the pressing table.

4. An abrading device as claimed in claim 1 characterized in that the pressing table comprises a framework pivoted to the pivotal arm and a set of ropes supported by rollers arranged in the framework and directly driven by a motor also held by the framework.

5. In an abrading machine or the like, the combination of:

a work support table presenting a generally horizontal surface against which a work piece is to be urged to control a depth of cut to be effected thereon;

abrading means projecting upwardly from said surface by a slight amount equal to said depth of cut for effecting such cut when a work piece is urged against said surface of the work support table;

table means spaced above said work support table for pressing a work piece downwardly against said surface toward an equilibrium position of said table means;

support means connected to said table means for floatingly positioning said table means at vertically adjusted equilibrium positions above said work support table, said support means comprising a vertically adjustable member, counterweight structure urging said table means upwardly and spring structure resiliently opposing the counterweight structure while urging said vertically adjustable member upwardly to establish an equilibrium position.

6. In an abrading machine as defined in claim 5 wherein said support means comprises connecting means operating through said spring structure and said vertically adjustable member for controlling the equilibrium position.

7. In an abrading machine as defined in claim 6 wherein said connecting means comprises a bell crank pivoted intermediate its ends to said pressing table means, one end of the bell crank being connected to said vertically adjustable member and the opposite end thereof being connected to the spring structure.

8. In an abrading machine or the like, the combination of:

a work support table presenting a generally horizontal surface against which a work piece is to be urged to control a depth of cut to be effected thereon;

abrading means projecting upwardly from said surface by a slight amount equal to said depth of cut for effecting such cut when a work piece is urged against said surface of the work support table;

table means spaced above said work support table for pressing a work piece downwardly against said surface toward an equilibrium position of said table means;

support means connected to said table means for floatingly positioning said table means at vertically adjusted equilibrium positions above said work support table, said support means comprising vertically adjustable means for changing the equilibrium position of said table means, compensating means for urging said table means upwardly, and means for resiliently opposing the compensating means while imposing an upward force on said vertically adjustable means to establish an equilibrium position.

9. In an abrading machine as defined in claim 8 wherein said support means also comprises connecting means operating through said spring means and said vertically adjustable means for controlling the equilibrium position.

10. In an abrading machine as defined in claim 9 wherein said connecting member comprises a bell crank pivoted intermediate its ends to said table means, one end of the bell crank being connected to said vertically adjustable means and the opposite end thereof being connected to the spring means.

* * * * *